US007784315B2

(12) United States Patent
Yang

(10) Patent No.: US 7,784,315 B2
(45) Date of Patent: Aug. 31, 2010

(54) LOCKING DEVICE FOR TRUCK

(76) Inventor: Ping-Jan Yang, P.O. Box 26-757, Taipei 106 (TW)

( * ) Notice: Subject to any disclaimer, the term of this patent is extended or adjusted under 35 U.S.C. 154(b) by 522 days.

(21) Appl. No.: 11/879,893

(22) Filed: Jul. 20, 2007

(65) Prior Publication Data

US 2009/0019903 A1 Jan. 22, 2009

(51) Int. Cl.
*E05B 47/00* (2006.01)

(52) U.S. Cl. ..... 70/279.1; 70/256; 70/275; 70/283; 292/DIG. 32

(58) Field of Classification Search ..... 70/52, 70/56, 104, 467, 468, 472, 478, 279.1, 256, 70/257, 275, 281–283; 292/DIG. 32, DIG. 65, 292/340

See application file for complete search history.

(56) References Cited

U.S. PATENT DOCUMENTS 2,650,388 A * 9/1953 White ..... 16/230
2,729,089 A * 1/1956 Pelcin ..... 70/151 R
3,157,042 A * 11/1964 Wolz ..... 70/279.1
4,665,727 A * 5/1987 Uyeda ..... 70/279.1
4,714,030 A * 12/1987 Cole ..... 109/61
4,866,963 A * 9/1989 Leininger et al. ..... 70/278.2
5,058,258 A * 10/1991 Harvey ..... 29/401.1
5,487,289 A * 1/1996 Otto et al. ..... 70/279.1
5,493,881 A * 2/1996 Harvey ..... 70/277
5,640,863 A * 6/1997 Frolov ..... 70/283
6,067,826 A * 5/2000 Holloway et al. ..... 70/278.3
6,116,067 A * 9/2000 Myers et al. ..... 70/279.1
6,293,131 B1 * 9/2001 Lemettinen et al. ..... 70/278.7
6,705,136 B2 * 3/2004 Porter ..... 70/210
6,732,664 B2 * 5/2004 Worrall ..... 109/68
6,745,603 B1 * 6/2004 Shaw ..... 70/278.1
6,843,084 B2 * 1/2005 Porter ..... 70/208
7,059,159 B2 * 6/2006 Lanigan et al. ..... 70/280
7,188,495 B2 * 3/2007 Errani et al. ..... 70/278.7
7,562,918 B2 * 7/2009 Toma et al. ..... 292/341.16
2006/0032418 A1 * 2/2006 Smith ..... 109/59 R
2006/0112746 A1 * 6/2006 Thompson ..... 70/257
2009/0027197 A1 * 1/2009 Frolov ..... 340/542

* cited by examiner

*Primary Examiner*—Suzanne D Barrett
(74) *Attorney, Agent, or Firm*—Kile Goekjian Reed & McManus PLLC

(57) ABSTRACT

A locking device for a truck is disclosed. The locking device is mounted on the door plank of a container door and is fastened in the doorframe in order to lock the container door. The device comprises a first body, a second body, and a lock. The first body includes a pushing element, a pressing element, and a driver unit. The end of the pressing element is pressed against the end of the pushing element. The driver unit is connected with the pressing element and is next to the second holder. The driver unit is electrically connected to the control unit. The second body includes a rotary element. The rotary element is stopped on the pressing element. The lock is disposed next to the first body. The present invention provides an improved locking device for a truck and ensures the safety of cargo when user forgets to lock the container.

12 Claims, 10 Drawing Sheets

LOCKING DEVICE FOR TRUCK

BACKGROUND OF THE INVENTION

1. Field of the Invention

The present invention relates to a locking device for a truck, and in particular to a locking device that provides an automatic switch for guarding against theft.

2. Description of Prior Art

Cargo transportation is an important part of global commerce. It is a large industry and encompasses sea transportation, land transportation, and air transportation. Moreover, cargo transportation is as important as manufacture or marketing. Great losses and contract problems are incurred to businesses if cargo can't be delivered completely and on time.

In general, land transportation by truck is the most common and cheap form of cargo transportation. A truck is designed to carry a container that has a container door. The door includes a latch and a door socket. The latch can be inserted in the door socket in order to lock the container door so as to avoid the theft or high-jacking of the cargo.

In the prior art, the lock is opened or closed manually by a key. But sometimes the driver of the truck may forget to lock the container door after undergoing a long drive. This allows the cargo to be high-jacked. Moreover the container door may open when the truck is being driven.

SUMMARY OF THE INVENTION

An object of the present invention is to provide a locking device for a truck, which has an automatic switch and a manual operation switch for preventing human error.

Another object of the present invention is to provide a locking device for a truck, wherein the automatic operation and the manual operation switch can be operated separately so that a driver can open the lock manually when the automatic switch is broken.

In order to achieve the above objects, the present invention provides a locking device for a truck. The device is mounted in the door plank of a container door, and fastens to the doorframe in order to lock the container door. The locking device comprises a first body that includes a pushing element, a first holder, a pressing element, a second holder, and a driver unit. The pushing element is penetrated movably through the first holder. The pressing element slidably pivots with the second holder. The end of the pressing element is pressed against the end of the pushing element. The pressing element is provided with a first elastic element. The first elastic element is connected to the second holder and swings elastically. The driver unit is connected with the pressing element next to the second holder and is electrically connected to the control unit.

A second body includes a rotary element, a second elastic element, and a doorknob. The rotary element pivots with the second body. Both ends of the second elastic element are respectively connected to the second body and the rotary element. The rotary element has a stopping portion and a pivotal hole. The stopping portion is disposed on the side edge of the rotary element for stopping the pressing element. The pivotal hole is disposed on the central point of the rotary element. The doorknob has a shaft and the shaft is pivoted with the pivotal hole of the rotary element. A lock has a latch bolt, and the latch bolt is pressed against the pushing element.

The present invention provides an improved locking device for a truck. The device is provided with the driver unit and the pressing element that locks the truck when through human error the lock has not been locked. The driver unit automatically locks the door the pressing element, if the driver forgets to lock the door.

Alternatively, the device having the control unit and the driver unit provides automatic and manual operation. A driver can open the lock manually, if the control unit or the driver unit is broken to ensure the door can be opened so as to avoid transport delays.

In order to better understand the characteristics and technical contents of the present invention, a detailed description thereof will be made with reference to the accompanying drawings. However, it should be understood that the drawing and the description are illustrative and should not be used to limit the scope of the present invention.

BRIEF DESCRIPTION OF THE DRAWINGS

The present invention can be fully understood from the following detailed description and preferred embodiment with reference to the accompanying drawings, in which.

DETAILED DESCRIPTION OF THE INVENTION

Figure 1:
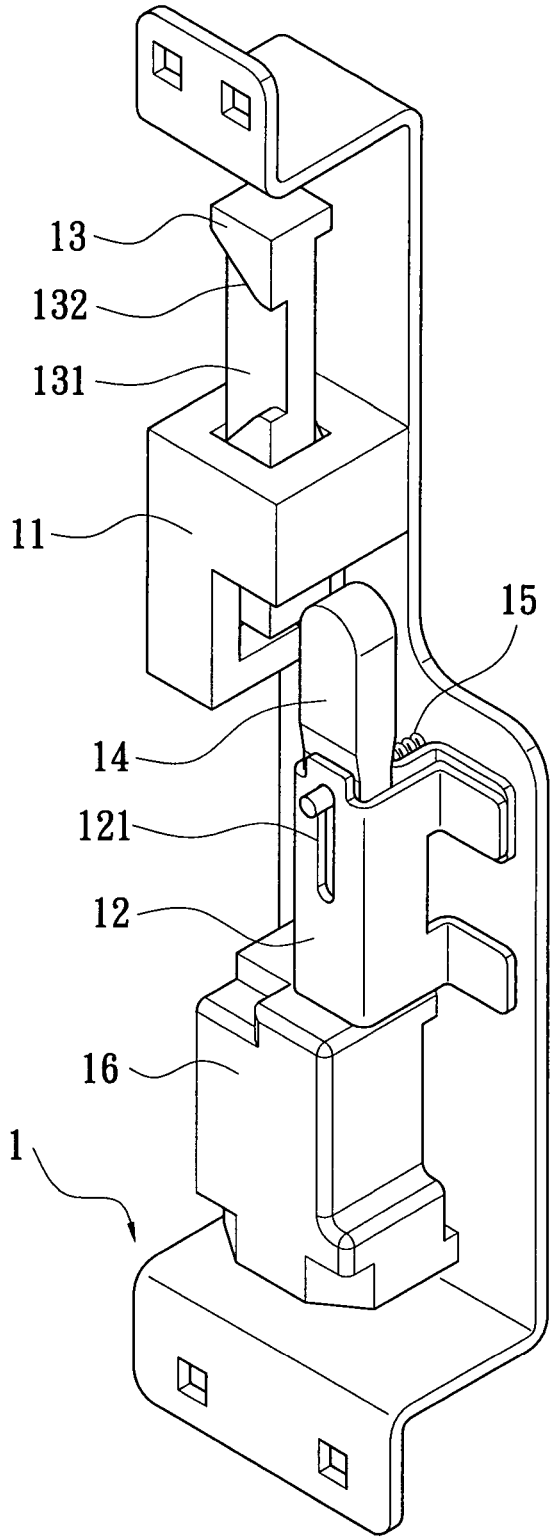
FIG. 1 is a perspective of the first body according to the present invention.

With reference to FIGS. 1 to 10, the present invention provides a locking device for a truck that is mounted in the door plank 41 of the container door 4 and through a latch 411 fastened with the door plank 41 in order to lock the container door 4. The locking device for a truck comprises a first body 1, a second body 2, and a lock 3.

Figure 2:
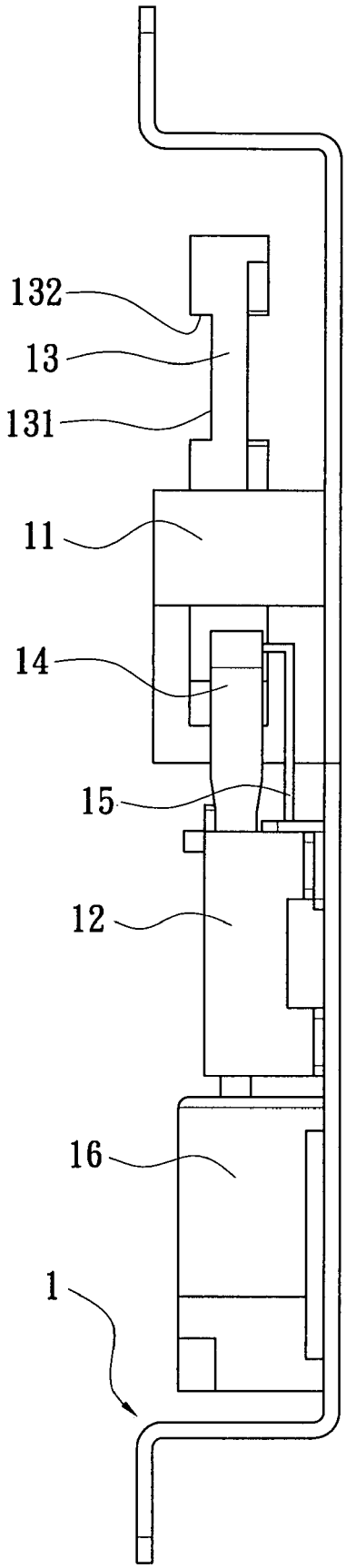
FIG. 2 is a side view of the first body according to the present invention.
Figure 3:
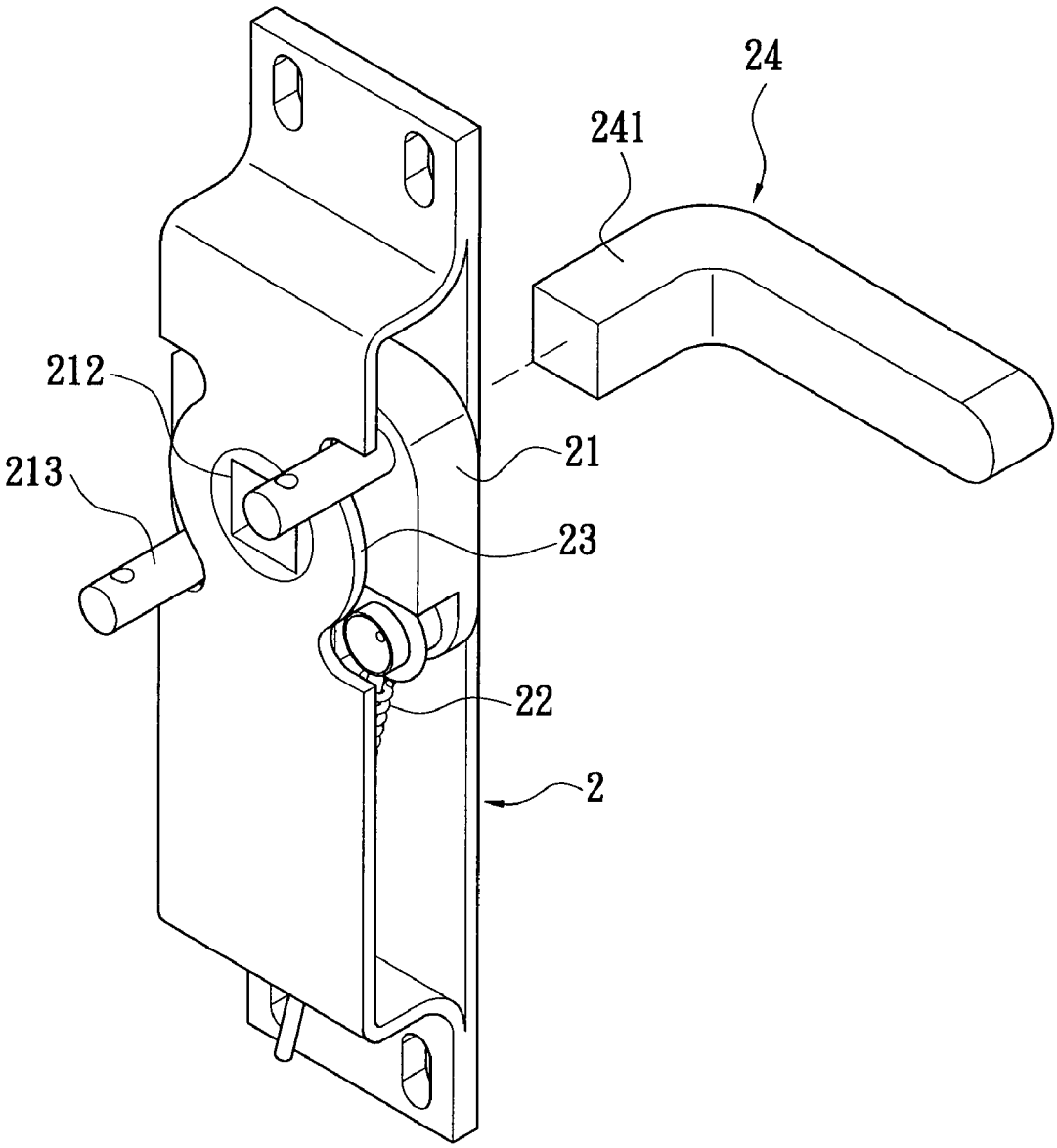
FIG. 3 is a perspective of the second body according to the present invention.
Figure 4:
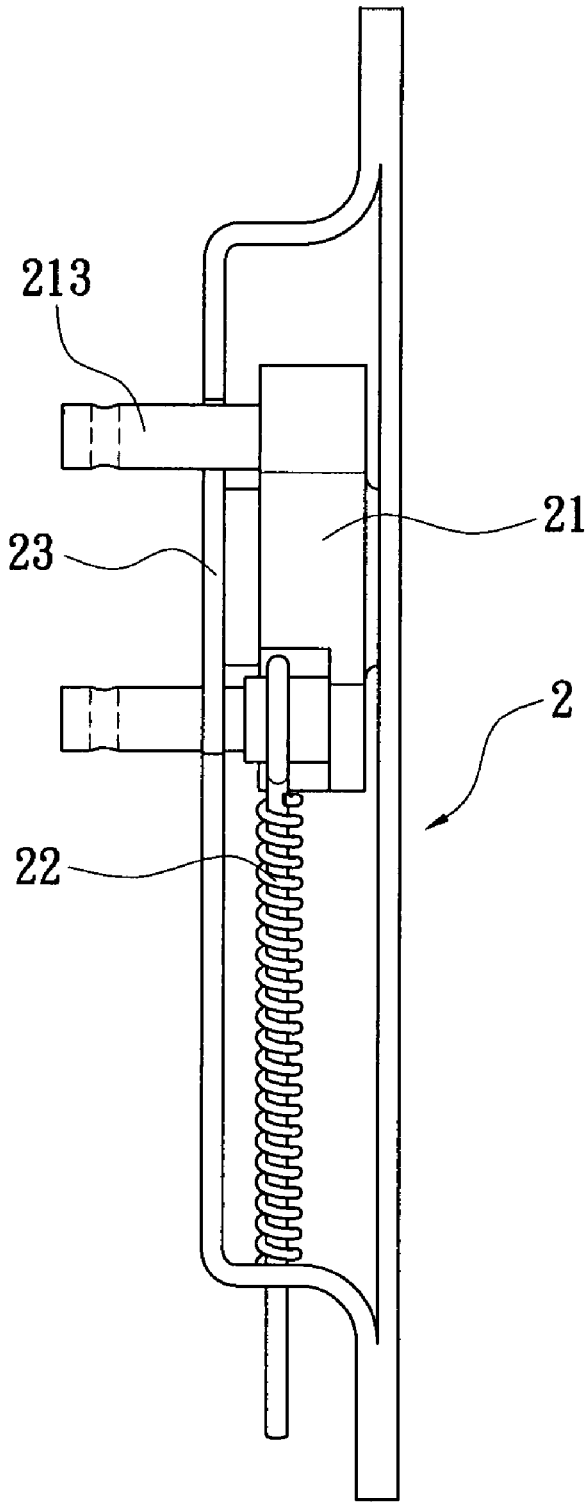
FIG. 4 is a side view of the second body according to the present invention.

With reference to FIGS. 1 to 2, the first body 1 is an oblong plank. A first holder 11, a second holder 12, a pushing element 13, a pressing element 14, and a driver unit 16 are disposed on the first body 1. The first holder 11 is fixed on the first body 1. The pushing element 13 is an oblong block that is slidably penetrated through the first holder 11. The pushing element 13 has a concave groove 131. The concave groove 131 is an opening space on the top side of the pushing element 13 and has a pair of opposite inclined sides 132.

The second holder 12 is fixed on the first body 1. The second holder 12 has a sliding cavity 121. The pressing element 14 is an oblong block that is pivoted with the second holder 12. The pressing element 14 can slide along the sliding cavity 121. A first elastic element 15 is disposed on the pressing element 14. The first elastic element 15 is a torsion spring that is connected to the second holder 12. Thereby the pressing element 14 can slide along with the sliding cavity 121 and elastically swing on the end of the second holder 12.

The driver unit 16 abuts against and connects with the second body 2. The driver unit 16 is a motor that drives the pressing element 14 to move linearly. A supply unit is electrically connected with the driver unit 16 for providing power to drive the driver unit 16. The supply unit can be a battery. A control unit 17 is electrically connected to the driver unit 16 for switching the driver unit 16 on and off.

With reference to FIGS. 1 to 5, the second body 2 is comprised of two planks. A rotary element 21 and a second elastic element 22 are disposed in between the two planks. The rotary element 21 is a structure that is tray-shaped. The rotary element 21 pivots with the second body 2. The rotary element 21 has a stopping portion 211 and a pivotal hole 212. The stopping portion 211 is formed via the surface of the rotary element 21. The stopping portion 211 presses against the end of the pressing element 14. The pivotal hole 212 is a hole that has an oblong shape. The second elastic element 22 is an extension spring. The two opposite ends of the second elastic element 22 are respectively connected with the rotary element 21 and the second body 2. The side of the second body 2 forms two sliding portions 23 that are arc-shaped. The rotary element 21 is formed with a pair of transmission axles 213. The pair of transmission axles 213 can be moved along the two sliding portions 23 when the rotary element 21 is rotated and through the force of the second elastic element 22 to be positioned on the opposite end of the sliding portion 23.

With reference to FIGS. 3 to 7, the lock 3 has a latch bolt 31 that can be rotated and a keyhole 32 into which a key 33 can be inserted. The lock 3 is located around the pushing element 13. The latch bolt 31 sticks in the concave groove 131, and leans against one of the inclined sides 132. Therefore, the latch bolt 31 can be rotated to drive the pushing element 13 to slide onto the first body 1.

The doorknob 24 has a shaft 241 that is inserted into the pivotal hole 212. The shaft 241 corresponding to the pivotal hole 212 is formed with an arm having a square cross-section.

Figure 5:
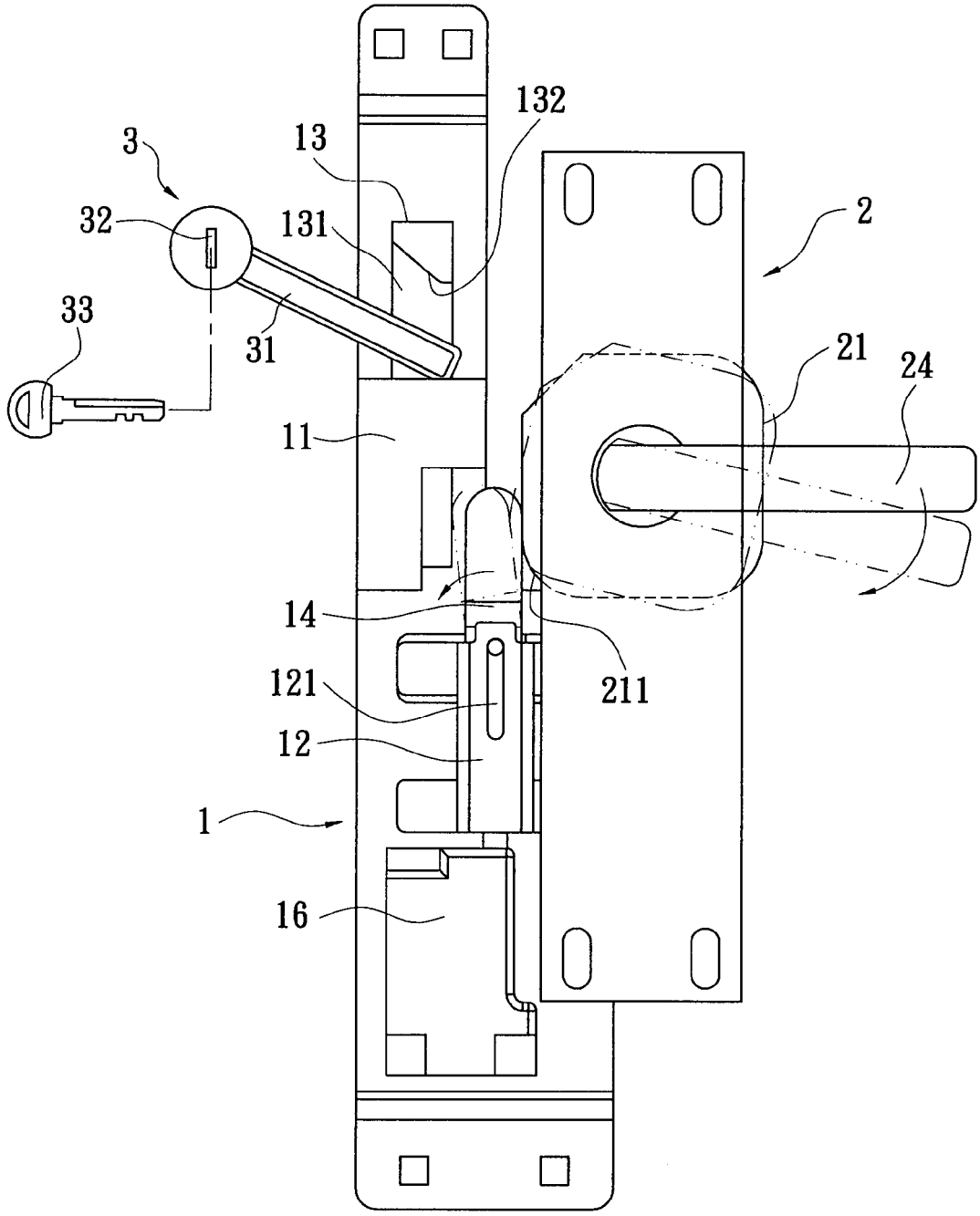
FIG. 5 is a front view of the locking device for a truck in the locked state according to the present invention.

With reference to FIG. 5, the pushing element 13 is pushed toward down by the latch bolt 31, therefore the pushing element 13 sticks out to another side of the first body 1. The pressing element 14 is driven by the driver unit 16 for posting at the end of the second holder 12 so the pressing element 14 can act as a swing. When a user rotates the doorknob 24 to open the door, the stopping portion 211 will be pressed against the end of the pressing element 14. The swinging action of the pressing element 114 will be limited at the same time so that the rotary element 21 cannot be rotated for locking the door.

Figure 6:
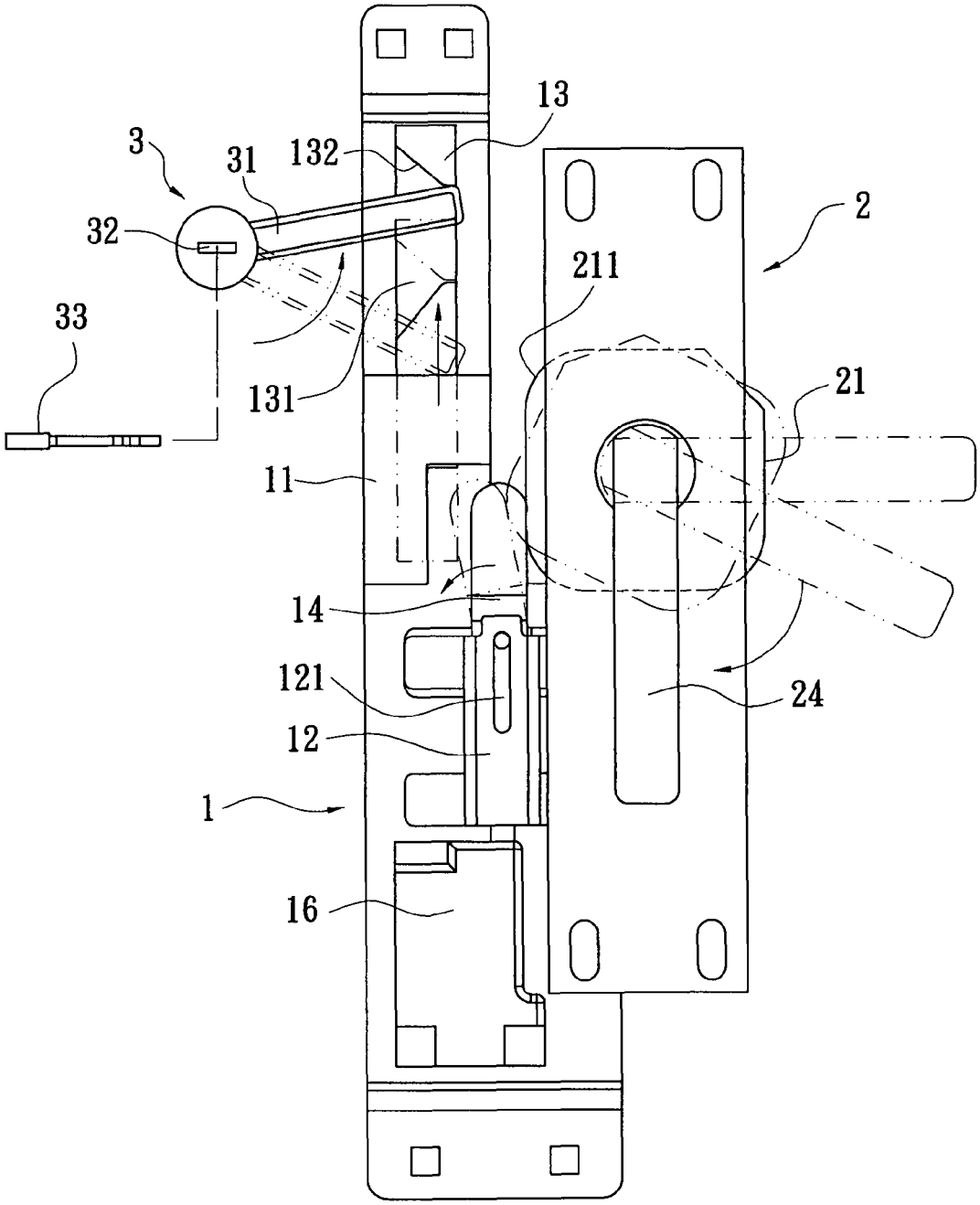
FIG. 6 is a front view of the first body in the unlocked state according to the present invention.

With reference to the FIG. 6, the pushing element 13 is carried via the latch bolt 31 to slide upward. When the pressing element 14 swings, allowing the rotary element 21 to rotate, the doorknob 24 can be rotated smoothly to engage the lock.

Figure 7:
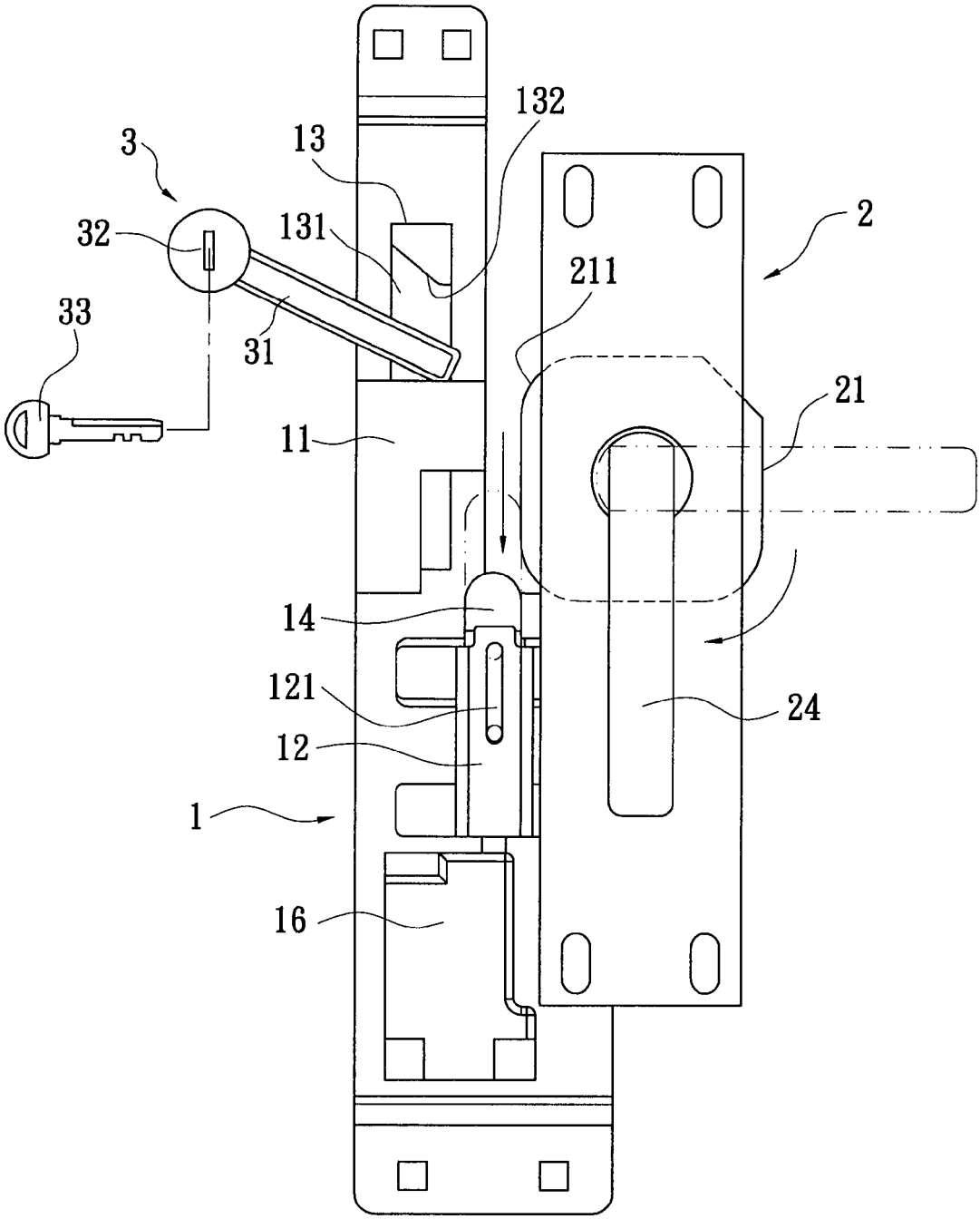
FIG. 7 is a front view of the second body in the unlocked state according to the present invention.

With reference to FIG. 7, the pressing element 14 is driven by the driver unit 16 to slide downward. The stopping portion 211 will be not contacted by the pressing element 14, so that the doorknob 24 can be rotated smoothly to engage the lock.

Figure 8:
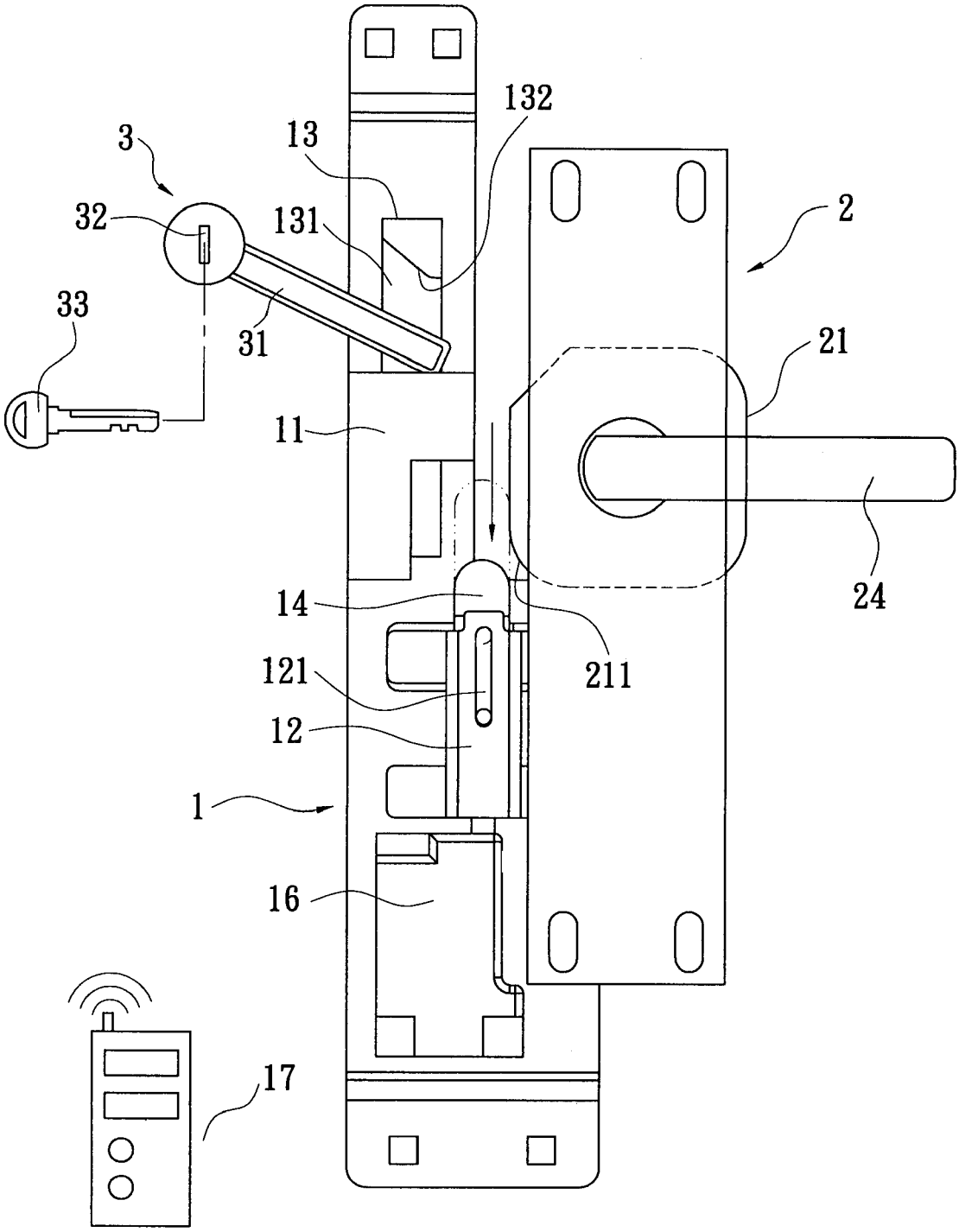
FIG. 8 is a front view of the locking device for a truck controlled via wireless means according to the present invention.
Figure 9:
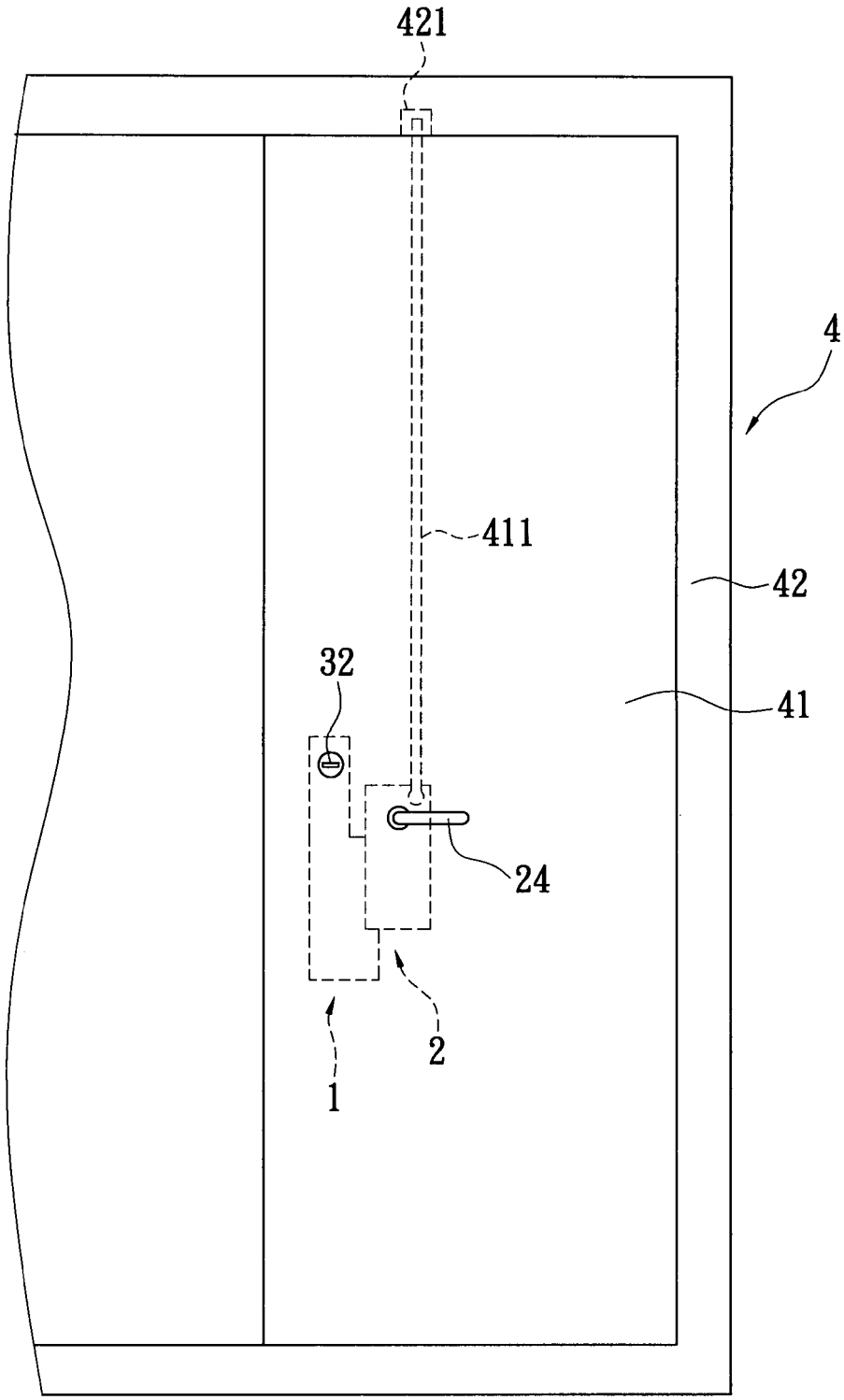
FIG. 9 is a front view of the locking device for a truck mounted with the container door in the locked state according to the present invention.
Figure 10:
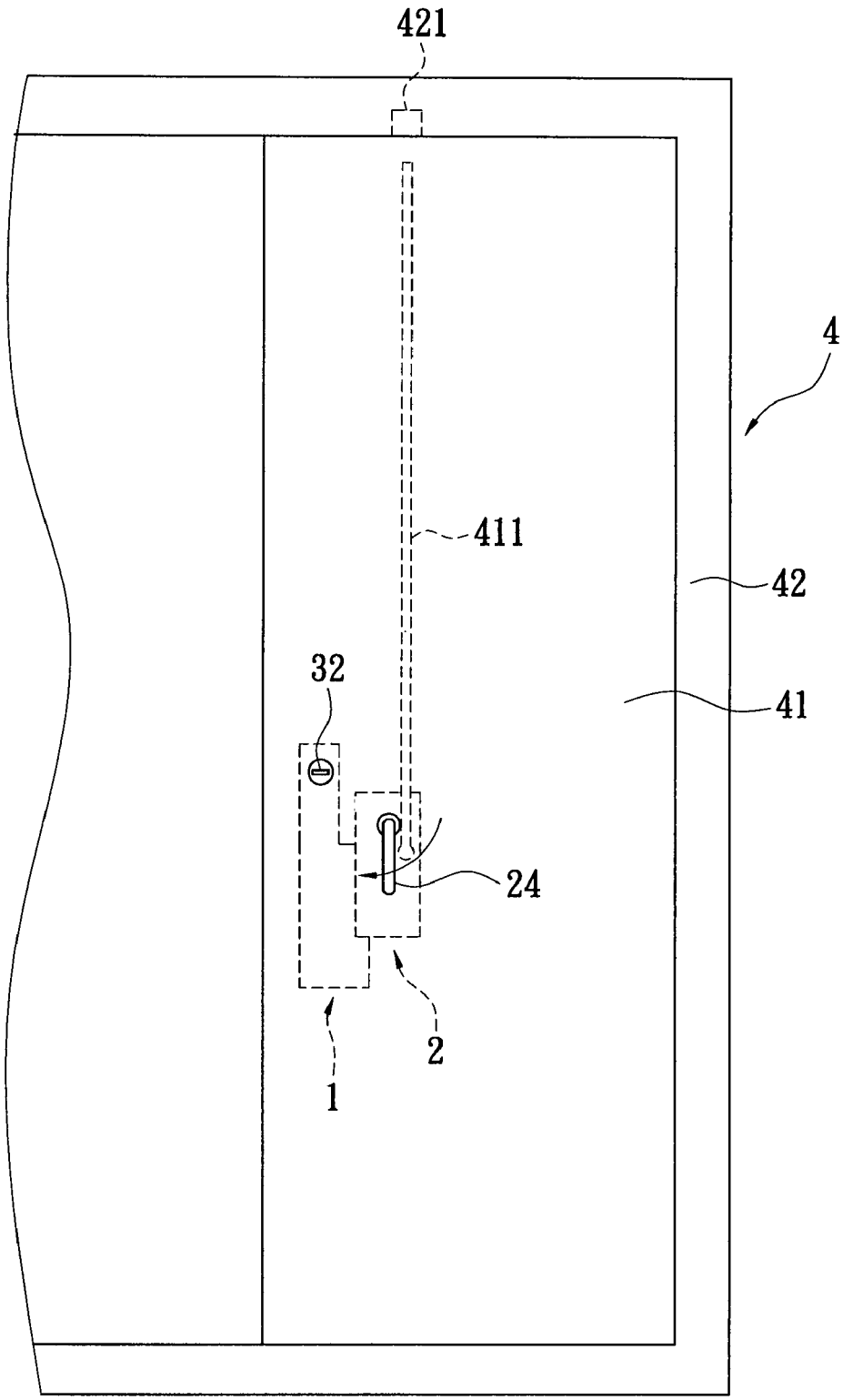
FIG. 10 is a front view of the locking device for a truck mounted with the container door in the unlocked state according to the present invention.

With reference to FIG. 8, the driver unit 16 is connected to the control unit 17 by means of a wireless connection or a cable. The control unit 17 is a remote control that controls the driver unit 16. The driver unit 16 is provided with a timing device for acting the driver unit 16 driving the pressing element 14 undergoing some time.

With reference to FIGS. 3, 5, 9, and 10, the present invention can be disposed in the container door 4. Moreover, the keyhole 32 is located on the surface of the door plank 41. The latch 411 is a circular stick that is longitudinally installed in the door plank 41. The doorframe 42 has a door socket 421. The latch 411 penetrates through the top side of the door plank 41 to insert into the door socket 421 in order to lock the container door 4.

When a user wants to lock the container door 4, he or she can rotate the doorknob 24 so that the latch 411 is carried by the rotary element 21 to move upward so as to lock the container door 4.

As described above, when a user wants to unlock the container door 4 he or she can rotate the doorknob 24 in a reverse direction to unlock the container door 4.

Accordingly, the present invention provides some advantage as are described below:

The present invention provides an improved locking device for a truck. The device is provide with the driver unit 16 and the pressing element 14 for ensuring the security of the container when somebody forgets to lock the container. The driver unit 16 drives the pressing element 14 to lock the door automatically if the driver forgets to lock the door.

Alternatively, the device has the control unit 17 and the driver unit 16 that provide automatic and manual operations. A user can open the lock manually when the control unit 17 or the driver unit 16 is broken to ensure that the door can be opened so that the cargo is not inadvertently delayed.

Although the present invention has been made with reference to the foregoing preferred embodiments, it will be understood that the invention is not limited to the details thereof. Various equivalents and modifications may still occur to those skilled in this art in view of teachings of the present invention. Thus, all such variations and equivalent modifications are also embraced within the scope of the invention as defined in the appended claims.

What is claimed is:

1. A locking device for a truck, the device being mounted in the door plank of a container door, and further fastened to the doorframe in order to lock the container door, the locking device comprising:

a first body that includes a pushing element, a first holder, a pressing element, a second holder, and a driver unit; the pushing element is penetrated movably through the first holder, the pressing element is slidably pivoted with the second holder, the end of the pressing element is pressed against an end of the pushing element, the pressing element is provided with a first elastic element, the first elastic element is connected to the second holder and swings elastically, the driver unit is connected with the pressing element next to the second holder, the driver unit is electrically connected to a control unit;

a second body including a rotary element, a second elastic element, and a door knob, the rotary element is pivoted with the second body, the two ends of the second elastic element respectively connected to the second body and the rotary element, the rotary element has a stopping portion and a pivotal hole, the stopping portion is disposed on the side edge of the rotary element for stopping the pressing element, the pivotal hole is disposed on the central point of the rotary element, the doorknob has a shaft, the shaft pivots with the pivotal hole of the rotary element; and a lock having a latch bolt, the latch bolt is pressed against the pushing element.

2. The locking device for a truck according to claim 1, wherein the pushing element has a concave groove and the concave groove has a pair of opposite inclined sides.

3. The locking device for a truck according to claim 2, wherein the latch bolt of the lock slides into the concave groove, and leans against one of the inclined sides.

4. The locking device for a truck according to claim 1, wherein the control unit is connected to the driver unit by means of a wireless connection or a cable connection.

5. The locking device for a truck according to claim 1, wherein the control unit is a remote control.

6. The locking device for a truck according to claim 1, wherein the driver unit connected in electrical communication with a supply unit.

7. The locking device for a truck according to claim 1, wherein the pivotal hole has a non-circular shape.

8. The locking device for a truck according to claim 1, wherein the cross section of the shaft has a non-circular shape.

9. The locking device for a truck according to claim 1, wherein the lock having a keyhole is located on the door plank.

10. The locking device for a truck according to claim 1, wherein the rotary element has at least one transmission axle that connects to a latch.

11. The locking device for a truck according to claim 10, wherein the second body has at least one sliding portion and the transmission axle moves along the sliding portion.

12. The locking device for a truck according to claim 10, wherein the doorframe has a door socket, the transmission axle carried to the latch to penetrate through the top side of the door frame, and inserts into the door socket.

* * * * *